United States Patent [19]

Bavaveas

[11] Patent Number: 4,726,495

[45] Date of Patent: Feb. 23, 1988

[54] PACKING FOR A PRODUCT IN POWDER FORM COMPRISING A FOOL-PROOF LOCK

[75] Inventor: Tristan Bavaveas, Paris, France

[73] Assignee: Societe EPARCO S.A., France

[21] Appl. No.: 798,628

[22] Filed: Nov. 15, 1985

[30] Foreign Application Priority Data

Nov. 29, 1984 [FR] France ..... 84 18175

[51] Int. Cl.[4] ..... B67D 5/64

[52] U.S. Cl. ..... 222/153; 222/171; 222/485

[58] Field of Search ..... 220/8; 206/823; 222/153, 169, 171, 189, 478, 480, 481, 482, 484–485, 522–525, 538, 559, 565–566; 251/100, 343

[56] References Cited

U.S. PATENT DOCUMENTS

| | | | |
|---|---|---|---|
| 4,419 | 3/1846 | Clarke | 251/100 |
| 1,745,382 | 2/1930 | Rogers | 222/525 |
| 3,258,030 | 6/1966 | Clark, Jr. | 251/100 X |
| 3,797,704 | 3/1974 | Dykes | 222/153 X |
| 4,162,746 | 7/1979 | Anderson et al. | 222/153 |
| 4,475,670 | 10/1984 | Rutter | 222/83 |

FOREIGN PATENT DOCUMENTS

| | | | |
|---|---|---|---|
| 543426 | 12/1973 | Switzerland | 222/525 |

*Primary Examiner*—Joseph J. Rolla
*Assistant Examiner*—Michael S. Huppert
*Attorney, Agent, or Firm*—Fred A. Keire

[57] ABSTRACT

A packaging for a product in a powder form including an upper housing, a co-axial lower housing a plug positioned internally and functioning in conjunction with the lower housing, and a tapered middle part for temporarily engaging the lower end section of the assembly including the upper housing and plug to the lower housing such that the assembly can be closed. A stop is also provided which restricts the axial sliding of the assembly and determines the maximum opened position of the assembly. A means is also provided to block the packing in the closed position which prevents axial sliding of the assembly but permits axial swiveling of the assembly in relation to the lower housing.

11 Claims, 5 Drawing Figures

BEST AVAILABLE COPY

PACKING FOR A PRODUCT IN POWDER FORM COMPRISING A FOOL-PROOF LOCK

BACKGROUND OF THE INVENTION

The present invention concerns a packing for a product in powder form comprising a sophisticated locking device.

There is already a history of devices designed to issue a given quantity of caustic product and used for cleaning out lavatories.

Such a device for cleaning out lavatories is specifically described in Swiss Pat. No. 543 426.

The device described in this patent includes a lower housing fitted with a top cover and fitted in its lower part with notched slits, a collar being provided between the lower edge of the said housing and the cover. The device also comprises a lower housing which can slide in relation to the upper housing. It includes an initial upper cylindrical part, a second lower cylindrical part and an intermediate tapered part. In addition, the device comprises a tapered plug which is fixed to the lower part of the upper housing and which operates in conjunction with the lower housing during the locking of the device.

The function of this plug is to discharge the powder product in the upper housing. When the device is open, the powder product flows along the walls of the tapered plug which is then released from the lower container and the powder product passes through the slits of the upper housing.

The plug, with the tip of its taper pointed in the direction of of the upper housing, also includes a leg routed from the upper housing to the lower housing. This central leg has a double function. First, it makes it possible to position the device in the lavatory so that the device lies along the same axis as the letdown orifice of the lavatory. Additionally, it prevents any inadvertant opening of the device. In fact, as the leg protrudes slightly from the lower housing when the device is positioned on a continuous plane, when the user presses on the cover of the upper housing, the leg lying on the continuous plane prevents opening.

The device does not allow full locking. Although the leg prevents opening, i.e. the release of the upper and lower housings, when the use applies axial pressure, it does not allow correct locking when the user performs a rotation around the device's longitudinal axis. By such a rotation and a simultaneous push, the user is able to open this device.

The device disclosed in Swiss Pat. No. 543 426 presents a serious disadvantage since the powder product contained in the upper housing is generally a dangerous product whose basic ingredient is frequently caustic soda. A child who performs a push and simultaneous rotation may inadvertently open the device and get the powder product on its hands or on some other part of its body, and this may cause accidents.

The present aim of the invention is to overcome these disadvantages.

SUMMARY OF THE INVENTION

One aim of the invention is to provide a packing for a product in powder form, particularly a caustic product, which cannot be inadvertently opened as it is fitted with a safety lock.

The packing of the present invention includes a gradually cyindrical upper housing closed at its upper end and including at its lower end section orifices provided in its side. In addition, the packing consists of:

a lower housing coaxial with respect to the upper housing the upper part of which is generally cylindrical with a radius r, the lower part is generally cylindrical with a radius R greater than the radius of the upper part, as well as a generally tapered middle part, the lower housing being open at its two ends, a plug positioned inside and functioning in conjunction with the lower housing. This plug is fitted with a stop engageable with the free edge of the lower end section of the upper housing such that the upper housing/plug assembly can slide axially between a locking position and a maximum opening position, means or temporarily engaging the lower end section of the upper housing/plug assembly to the lower housing to permit locking of the assembly to the lower housing, means to check the axial sliding of the upper housing/plug assembly in relation to the lower housing such that the maximum opening position can be determined.

The present invention ensures blocking in the locked position and prevents axial sliding while at the same time enabling axial rotation of the upper housing/plug assembly in relation to the lower housing.

The blocking means includes at least one cut-off which butts against a circular check including at least one discontinuity; the cut-off prevents axial sliding when it is not opposite the discontinuity.

In one version of the invention, the cut-off may be located on the the lower housing and the check may be located on the upper housing.

In a different version, the cut-off is located on the upper housing and the check is located on the lower housing.

The cut-off and the check may also be located in the inside space between the external wall of the upper housing and the internal wall of the lower housing.

The cut-off and the check may be located on the external walls of the housings.

In one embodiment of the invention, the cut-off is a swivel-pin and a discontinuous check defines a clip. In a second embodiment, the cut-off is a longitudinal lug and the discontinuous check is a collar assembled on the external wall of the upper housing, while the free edge of the lug butts against the check.

Finally, internal teeth may be provided to fix the direction of rotation for opening.

Moreover, the plug may form an integral part of the upper housing, i.e. the plug and the upper housing may be in a single casting. In addition, the plug is tapered and has no axial leg.

BRIEF DESCRIPTION OF THE DRAWINGS OF THE PREFERRED EMBODIMENTS

The following detailed description, given by way of example, and not intended to limit the present invention to the embodiments shown herein, may best be understood in conjunction with the accompanying drawings in which.

Figure 2:
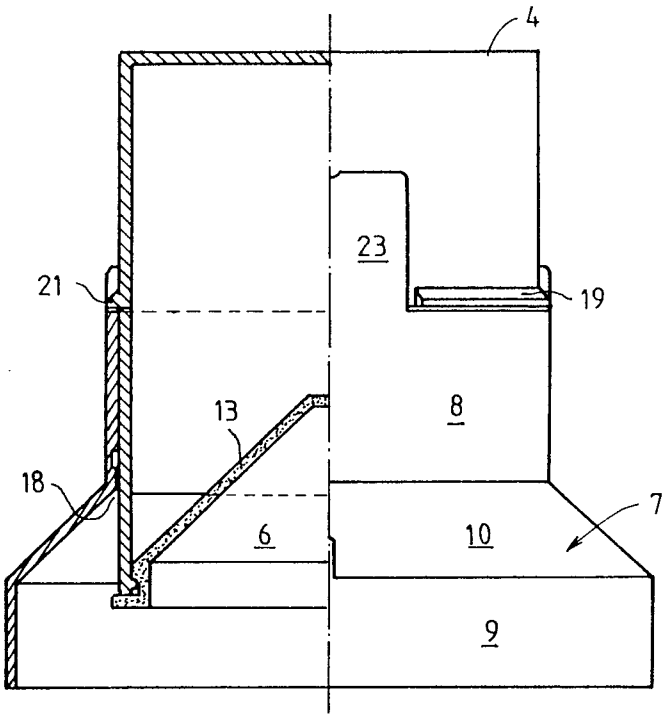
FIG. 2 is a half-section view of the device of FIG. 1 in the opened position.

The device 1 includes an upper housing 2 which is generally cylindrical with an axis of rotation xx, closed at its upper end 3 by a cover 4 and including at its lower end section 5 orifices 6 provided in the side. A lower housing 7 is co-axial with respect to the upper housing 2 and consists of an upper part 8, a lower part 9 and a middle part 10. The upper part is generally cylindrical with an axis of rotation xx, the radius r of the upper part being smaller than the radius R of the lower part 9. The middle part 10 is generally tapered. The lower housing 7 is open at its two ends 11 and 12 and is slideable in relation to the upper housing 2.

In addition, the device includes a plug 13 fitted internally within the packing and operating in conjunction with the lower housing 7. The plug 13 is fitted with a stop engageable with the free edge 15 of the lower end section 5 of the upper housing 2. The assembly including the upper housing 2 and the plug 13 being able to slid axially between a closed position (shown in FIG. 1) and a maximum opened position (shown in FIG. 2).

In accordance with a known technique, the fixings 14 of the plug 13 may include a external groove 16 and a contiguous flange 17, the flange 17 engaging in an internal groove 18 of the lower housing while the external groove 16 functions in conjunction with studs assembled inside the lower end section 5 of the upper housing 2.

In accordance with the present invention, a design may be provided whereby the upper housing 2 and the plug 13 comprise a single cast or injected part. In this configuration the plug 13 does not have groove 16 and only includes a circular flange 17.

The flange 17 constitutes temporary fixings 18 between the lower end section 5 of the assembly (i.e. the upper housing 2 and the plug 13) and the lower housing 7. These temporary fixings 18, when in operation, determine closing and when these temporary fixings are not in operation (see FIG. 4), they determine opening.

In addition, the device includes means 19 for checking the axial sliding of the assembly comprising the upper housing 2 and the plug 13 in relation to the lower housing 7. When in operation, the checking means 19 determines the maximum opening position (FIG. 2) of the assembly.

In accordance with a known technique, the means 19 for checking axial sliding consists of the free upper edge 20 of the upper part of the lower housing 7 and a collar 21 assembled in the middle of the upper housing 2.

The collar 21 is positioned outside the upper housing 2.

Figure 1:
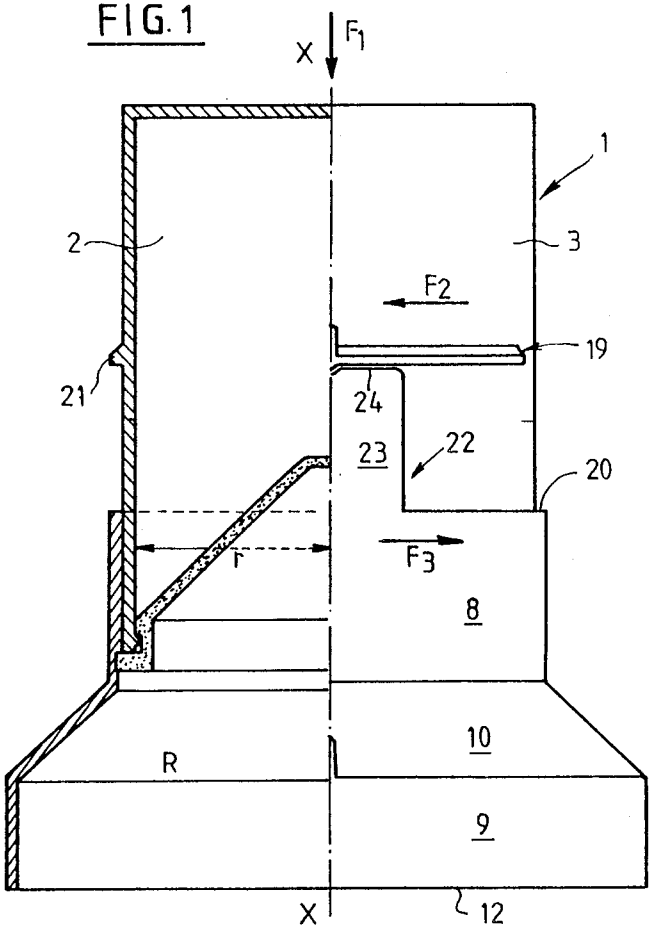
FIG. 1 is a half-section view of one embodiment of the present invention in the closed position.
Figure 3:
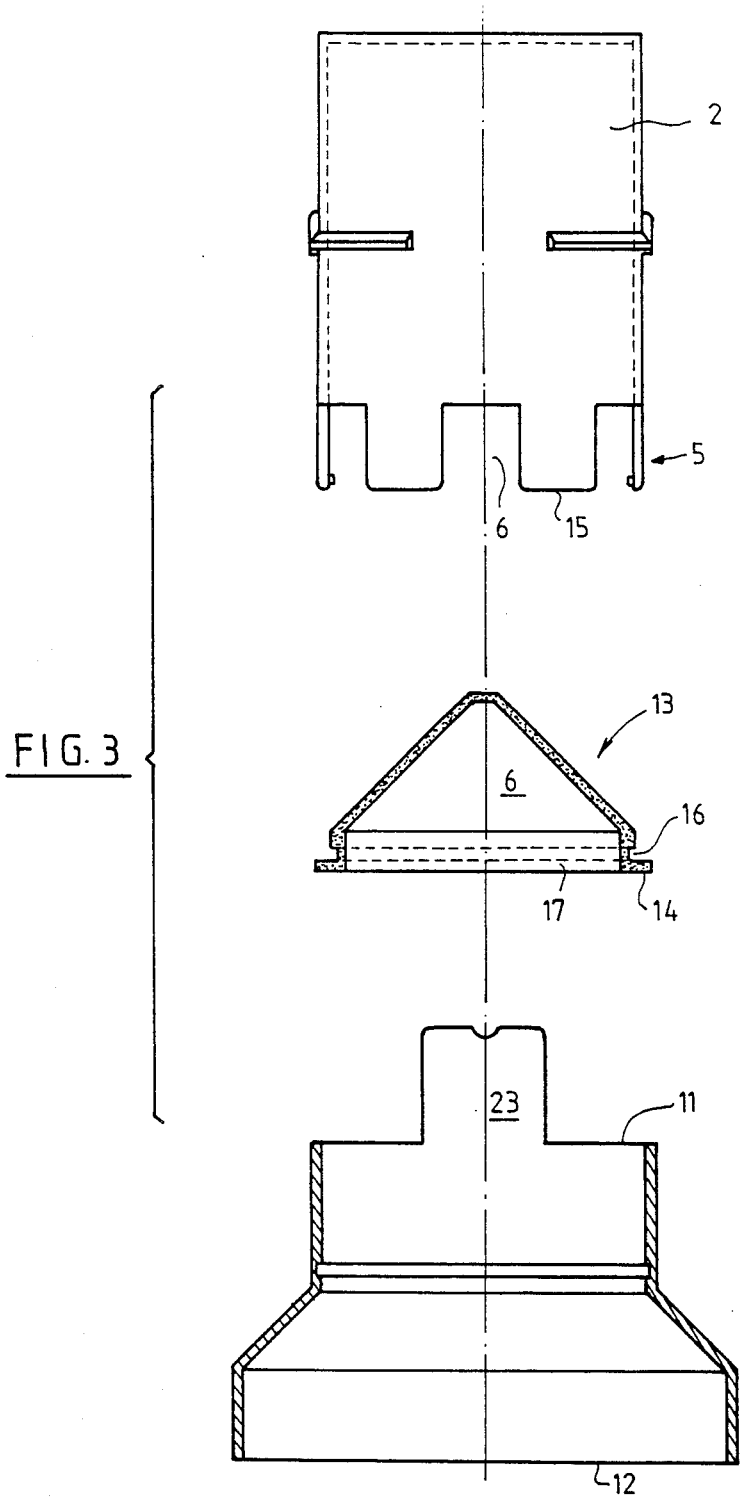
FIG. 3 is a front elevational view of the various parts of the device in accordance with the invention.
Figure 5:
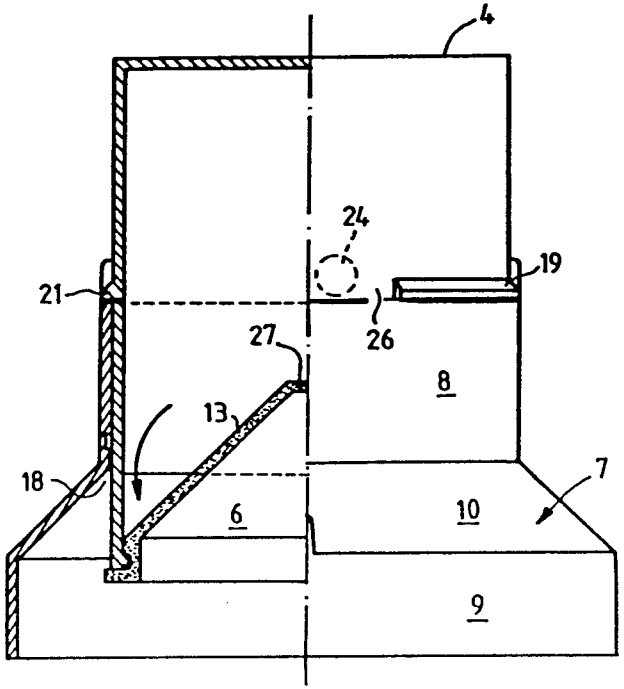
FIG. 5 is a half-section view of the device of FIG. 4 in the opened position.

The present invention includes means 22 for blocking the packing in the closed position (see FIGS. 1 and 5). The function of the blocking means 22 is to prevent axial sliding of the upper housing 2 in relation to the lower housing 7 while enabling axial swiveling of the assembly (ie. the upper housing 2 and the plug 13, in relation to the lower housing 7.

In one embodiment of the present invention, the blocking means 22 includes at least one cut-off 23 butting against the circular check 21. The circular check including at least one discontinuity 24 such that when the cut-off 23 is not opposite the discontinuity 24, axial sliding is prevented.

FIG. 1 clearly shows that when the cut-off 23 abuts against the check 21 as a result of an axial push being exerted in the direction of the arrow F1, i.e. so as to draw the upper housing 2 and the lower housing 7 closer together, the cut-off 23 resting against the check 21 does not allow the drawing together and therefore the displacement of the two housings. On the contrary, when performing a rotation of the upper housing 2 in the direction of the arrow F2 or of the lower housing 7 in the direction of the arrow F3, opposite to the direction of the arrow F2, the cut-off 23 moves opposite the discontinuity 24. However, as the discontinuity 24 is sized similarly to the cut-off 23, when a push is exerted in the direction of the arrow F1, the cut-off 23 engages in the discontinuity 24 and the two housings 2 and 7 draw closer together as they slide.

Figure 4:
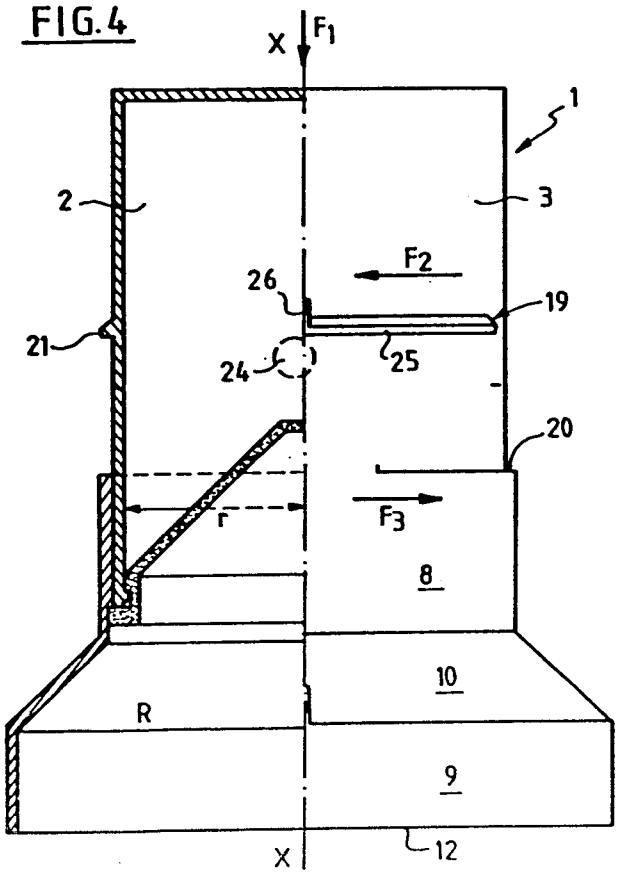
FIG. 4 is a half-section view of a second embodiment of the present invention in the closed position.

The collar 21 therefore draws close to the free edge 20 and when the collar 21 butts againsts the edge 20 of the housing 7, the housings 2 and 7 are as close together as possible and the device is in the maximum opened position (FIGS. 2 and 4).

In another embodiment of the invention, the cut-off 23 is located on the lower housing 7 and the check 21 is located on the upper housing 2. However, the reverse may also be provided, i.e. the cut-off 23 is located on the upper housing 2 and the check 21 is located on the lower housing 7.

In the embodiment of the present invention shown in FIGS. 1, 2, 3 and 4, the cut-off 23 is a longitudinal lug and the discontinuous check 21 is a collar assembled on the external wall of the upper housing 2, the free upper edge 24 of the lug butting against the cheek 21.

FIGS. 5 and 6 illustrate another embodiment of the present invention.

The device shown in FIG. 5 in the closed position includes a cut-off and a check located in the internal space between the external wall of the upper housing 2 and the internal wall of the lower housing 7.

The cut-off is located on the outside wall of the upper housing 2 while the check is located on the internal wall of the housing 7.

The cut-off is a study 24 and the check is a clip 25, the clip being assembled on the external wall of the upper housing 2. During rotation of the upper housing 2 in the direction of the arrow F3 in relation to the lower housing 7, the stud 24 moves opposite the interstice 26 of the clip 25 (FIG. 4). When, however, a push is exerted in the direction of the arrow F1, the stud 24 crosses the interstices of the clip 25 and the upper housing 2 may be drawn closer to the lower housing 7 (FIG. 5).

The safety device including the means 22 for blocking the packing in accordance with the present invention makes it possible to design the plug 13 in the form of a taper the top 27 of which is pointed towards the upper housing 2. This plug 13, unlike the former technique, does not therefore include a tip except when the device is assembled on a continuous plane resting on the latter such that any opening of the packing as defined by the present invention is prevented.

Finally, it is possible to provide teeth (not shown) which determine a possible direction of rotation of the upper housing 2 in relation to the lower housing 7.

What is claimed is:

1. A packing for a product in powder form comprising:

a generally cylindrical upper housing closed at its upper end and including at its lower end section orifices provided in its side and a free edge;

a lower housing co-axial with respect to the upper housing, the upper part of which is generally cylindrical with a radius r, the lower part is generally cylindrical with a radius R greater than the radius of the upper part, and with a generally tapered middle part, the lower housing being open at its two ends;

a plug positioned internally within the lower housing and fitted with means engageable with the free edge of the lower end section of the upper housing, the upper housing and the plug defining an assembly sliding axially between a closed position and a maximum opened position;

means provided on the lower housing for temporarily engaging the lower end section of the assembly to the lower housing to permit locking of the assembly to the lower housing;

a circular check provided substantially circumferentially around the upper housing for checking the axial sliding of the assembly in relation to the lower housing to define the maximum opened position of the assembly;

means for blocking the packing in the closed position preventing axial sliding of the upper housing in relation to the lower housing while enabling axial swiveling of the assembly in relation to the lower housing, the blocking means including at least one cut-off abutting against the circular check which includes at least one discontinuity such that when the cut-off is not aligned with the discontinuity, axial sliding is prevented.

2. The packing in accordance with claim 1 wherein the cut-off is located on the lower housing and the check is located on the upper housing.

3. The packing in accordance with claim 2 wherein the cut-off is a stud and the discontinuous check is a clip.

4. The packing in accordance with claim 2 wherein the cut-off is a longitudinal lug and the discontinuous check is a collar assembled on the external wall of the upper housing, the free edge of the lug abutting against the check.

5. The packing in accordance with claim 1 wherein the cut-off is located on the upper housing and the check is located on the lower housing.

6. The packing in accordance with claim 1 wherein the cut-off and the check are located in an internal space positioned between the outside wall of the upper housing and the internal wall of the lower housing.

7. The packing in accordance with claim 1 wherein the cut-off and the check are located on the external walls of the housings.

8. The packing in accordance with claim 1 wherein the plug forms an integral part of the upper housing.

9. The packing in accordance with claim 1 wherein the plug is tapered with the top of the taper being pointed towards the upper housing.

10. The packing in accordance with claim 10 wherein the plug includes only a circular flange functioning in conjunction with the lower housing and including the means for temporarily engaging the lower end section of the assembly to the lower housing.

11. The packing in accordance with claim 1 wherein both the blocking means and the checking means include the circular check.

* * * * *